US005334806A

United States Patent [19]

Avery

[11] Patent Number: 5,334,806

[45] Date of Patent: Aug. 2, 1994

[54] TEMPERATURE AND SOUND INSULATED PANEL ASSEMBLY

[75] Inventor: Elliott L. Avery, Hinsdale, Ill.

[73] Assignee: Transco Inc., Chicago, Ill.

[21] Appl. No.: 778,733

[22] Filed: Oct. 18, 1991

[51] Int. Cl.[5] ..... E04B 1/82

[52] U.S. Cl. ..... 181/286; 181/290; 181/294

[58] Field of Search ..... 181/284, 285, 286, 287, 181/290, 294; 52/145, 622, 410

[56] References Cited

U.S. PATENT DOCUMENTS

| | | | |
|---|---|---|---|
| 3,652,360 | 3/1972 | Hartman et al. | 181/294 |
| 3,879,910 | 4/1975 | Waite | 52/145 |
| 4,120,376 | 10/1978 | Palmer | 181/284 X |
| 4,823,909 | 4/1989 | Nakamura et al. | 181/290 |

OTHER PUBLICATIONS

Article "Sound, Noise and Ultrasonics," by B. Carlin, pp. 12.135–12.143.

ASTM Standard D747-86 entitled "Standard Test Method for Apparent Bending Modulus of Plastics by Means of a Cantilever Beam".

ASTM Standard D792-86 entitled "Standard Test for Specific Gravity (Relative Density) and Density of Plastics by Displacement".

ASTM Standard D412-87 entitled "Standard Test Methods for Rubber Properties in Tension".

ASTM Standard D624-86 entitled "Standard Test Method for Rubber Property-Tear Resistance".

ASTM Standard D2240-86, "Standard Test Method for Rubber Property-Durometer Hardness".

*Primary Examiner*—Michael L. Gellner
*Assistant Examiner*—Khanh Dang
*Attorney, Agent, or Firm*—Wallenstein, Wagner & Hattis. Ltd.

[57] ABSTRACT

The present invention is a thermal and acoustical insulation wall panel assembly that incorporates a synthetic vinyl. This panel assembly reduces the amount of hazardous waste and the cost of manufacturing, shipping and installing the insulation. The panel is comprised of a plurality of superimposed layers. One layer is a rigid facing which is preferably corrugated for supporting the panel. Attached to this facing are, in sequential layers, a thermal-insulating batt, a mass-loaded vinyl sheet for acoustic-insulation, a second thermal-insulating batt, a heat-reflective backing, and a retainer. A plurality of connectors are used to hold the plurality of superimposed layers together.

17 Claims, 1 Drawing Sheet

TEMPERATURE AND SOUND INSULATED PANEL ASSEMBLY

TECHNICAL FIELD

The present invention relates generally to a prefabricated wall panel assembly for both thermal and acoustical insulation and is composed of a plurality of superimposed layers, including a layer of a mass-loaded vinyl which reduces hazardous waste and the cost of manufacturing, shipping and installing the insulation.

BACKGROUND PRIOR ART

Thermal and acoustical wall paneling composed of a plurality of superimposed layers are well known in the art. An example of such an insulation panel is exemplified in U.S. Pat. No. 3,879,910, which is incorporated by reference herein. Insulation panels of this type are typically prefabricated to dimensions that make them manageable during manufacture, shipping and installation. In use, the panels are generally placed end-on-end, to cover the desired surface.

As disclosed in the foregoing patent, the layers of such an insulation panel can include a sound-absorbing lead sheet, several layers of heat-absorbing or heat-reflective material, and a facing for maintaining the rigidity of the panel. It is no coincidence that lead is used as the sound-absorbing layer. Conventional wisdom has long held that the higher the density of the sound-absorbing member, the better the acoustical properties of the panel. Because lead is well known for its large density, it is frequently used as the preferred sound-absorbing material in the insulating industry today.

However, while lead is preferred, there are, unfortunately, many hazards now known to be associated with it. Thus, many safety guidelines and environmental controls that have been implemented to protect workers and users from coming in contact with the material and prevent water supplies from becoming contaminated with lead or lead byproducts. Despite these guidelines and controls, there continues to be a great deal of debate surrounding the harmful effects of lead on humans and the environment.

An additional problem in using lead is its expense. The numerous safety guidelines and environmental controls associated with the use of lead, result in an increase in the cost of products that contain it. In addition, the manufacturing, the shipping and the installation costs associated with it are significantly greater due to its weight.

Finally, because lead is considered a hazardous material, its disposal costs are high. Unfortunately, substitute materials for lead in the area of sound reflection are few. Conventional wisdom in this area has directed the industry away from synthetic materials and towards high density metallic sound reflecting materials.

SUMMARY OF THE INVENTION

The present invention is a thermal and acoustical insulation, preferably in the form of a wall panel, that incorporates a synthetic vinyl. The panel is comprised of a plurality of superimposed layers, one layer being a rigid facing which is corrugated for supporting the panel. Attached to this facing are, in sequential layers, a thermal-insulating batt, an mass-loaded vinyl sheet for acoustic-insulation, a second thermal-insulating batt, a heat-reflective backing, and a retainer. A plurality of connectors are used to hold the superimposed layers together.

An important advantage of the present invention is that it reduces hazardous waste. By utilizing mass-loaded vinyl in the present insulation in place of lead, many of the risks and real dangers facing both workers and the environment are avoided. In addition, the reduction of hazardous waste helps to relieve the growing demand for scarce hazardous waste storage facilities.

An additional advantage of the present invention is that mass-load vinyl can dramatically reduce the cost of thermal and acoustical insulations. The unit-cost of mass-load vinyl is substantially less than that of lead. In addition, by using mass-load vinyl in place of lead, the cost of transportation is reduced and handling is made easier during manufacture and installation. Disposal costs are also dramatically reduced.

A further advantage of the present invention is that because of the density and the mass of the mass-loaded vinyl, its performance should be substantially equal in acoustical characteristics to lead type insulations. Specifically, hysteresis effects do not erode the density of the product as compared with an unflexed product.

An even further advantage of the present invention is that the mass-loaded vinyl has a lower thermal conductivity than that of lead. Consequently, insulation utilizing mass-loaded vinyl has a higher thermal performance than conventional lead-type insulation.

Other advantages and aspects of the present invention will become apparent upon reviewing the following drawings and reading the following detailed description of the invention.

DETAILED DESCRIPTION OF THE INVENTION

Figures 1, 2, 3, 4, 5, 6, 7:
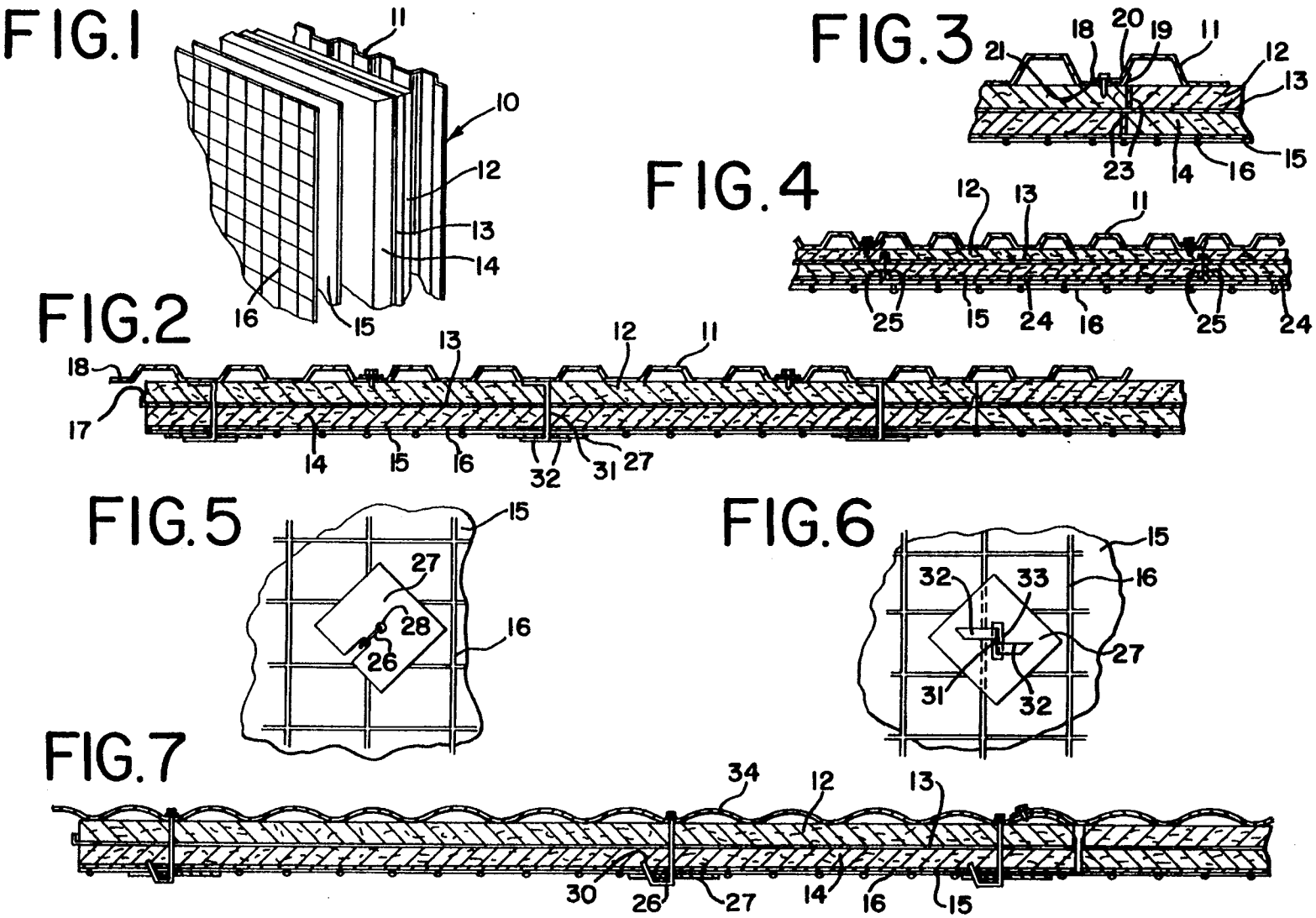
FIG. 1 is a fragmentary perspective view of the preferred panel of the present invention showing the components thereof in exploded relation one to the other.
FIG. 2 is a detailed sectional view taken through a prefabricated panel.
FIG. 3 is a fragmentary detailed sectional view showing the preferred form of abutment and connection between certain components of the prefabricated panel of the present invention.
FIG. 4 is a fragmentary detailed sectional view showing a modified panel section.
FIGS. 5 and 6 are fragmentary plan views of different forms of connectors utilized with this invention; and, FIG. 7 if a fragmentary detailed sectional view of a modified form of the panel.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

This invention relates to a self-supporting wall panel, shown generally by reference numeral 10, and includes a plurality of structural components. One such component is a metallic exterior facing 11 which is preferably corrugated for added rigidity and strength. Placed on one side of the corrugated facing 11 is a batt of thermal insulating material 12. This insulating material may be a ply of glass fiber or the like. If a glass fiber ply is used, it should be slightly compressed and bonded together by a suitable resin or the like.

On the exposed surface of the batt 12 is placed an acoustical insulating sheet of mass-loaded vinyl 13 which may be of a thickness such that its weight would approximate one pound per square foot. Mass-loaded vinyl is a relatively new synthetic product. A manufacturer of such a material is V.P.I., Vinyl Plastics Inc. of Manitowoc, Wis.

In the preferred embodiment, the mass-loaded vinyl sheet is constructed so as to have a thickness of about 0.03 inches, a base weight of about 15.7 ounces per square foot, an apparent bending modulus of about 25.2 MPA, a specific gravity of about 1.87 grams per cubic centimeter, a tensile strength of about MD=415 psi and AMD=409 psi, a percent elongation of about MD=105% and AMD=128%, a tear of about MD=92 lbfs./in. and AMD=91 lbfs./in., and a hardness of about 84 Type A-2 Shore durometers. These values are calculated in accordance with the American Society for Testing and Materials (ASTM) standard test methods were applicable.

Specifically, the apparent bending modulus (relative flexibility) is calculated pursuant to ASTM D 747-86, Apparent Bending Modulus of Plastics by Means of a Cantilever Beam, approved Oct. 31, 1986. This ASTM standard defines apparent bending modulus as an apparent modulus of elasticity obtained in flexure, using a cantilever beam testing apparatus, where the deformation involved is not purely elastic but contains both elastic and plastic components.

Additionally, the specific gravity is calculated pursuant to ASTM D 792-86, Standard Test Methods for Specific Gravity (Relative Density) and Density of Plastics by Displacement, approved May 30, 1986. ASTM D 792 defines specific gravity (relative density) to be the ratio of the weight in air of a unit volume of the impermeable portion of the material at 23 Degrees Celsius (73.4 Degrees Fahrenheit) to the weight in air of equal density of an equal volume of gas-free distilled water at the same temperature. Density is defined as the weight in air in milligrams per cubic meter of impermeable portion of the material at 23 Degrees Celsius. A specimen of the solid plastic is weighed in air. It is then immersed in a liquid, its loss in weight upon immersion is determined, and its specific gravity (relative density) calculated.

The tensile strength and percent elongation are calculated in accordance with ASTM D 412-87, Standard Test Methods for Rubber Properties in Tension, approved Mar. 27, 1987. The determination of tensile properties starts with a piece taken from the sample and includes: 1) the preparation of the specimen and 2) testing of the specimen. Specimens may be in the shape of a dumbbell, ring, or straight piece of uniform cross section. Measurements for tensile stress, tensile strength and ultimate elongation are made on specimens that have not been prestressed, where MD and AMD mean designate machine draw and against machine draw respectively. Since the vinyl product is extruded, it is tested both parallel to the direction of the draw (MD) and against the direction of the draw (AMD). Tensile stress and tensile strength are based on the original cross sectional area of a uniform section of the specimen. Measurement of tensile set is made after a previously unstressed specimen has been extended and allowed to retract by a prescribed procedure. Measurement of tensile set after break is also used.

The tear is calculated pursuant to ASTM D 624-86, Standard Test Method for Rubber Property Tear Resistance approved Mar. 27, 1986. This test method uses three independent specimen shapes, namely a razor-nicked crescent specimen (Die A), a razor-nicked crescent specimen with tab ends (Die B) and an unnicked 90° angle specimen (Die C), to determine the tear resistance valve. Again, the designation MD is in the machine draw direction of the material and AMD is the against machine draw direction of the material.

The hardness is calculated pursuant to ASTM D 2240-86, Standard Test Method for Rubber Property-Durometer Hardness, approved Mar. 27, 1986. This test method covers Type A durometers, used for testing softer materials, and the procedure for determining the indentation hardness of homogeneous materials ranging from soft vulcanized rubber to some plastics. This test method permits hardness measurements based on either initial indentation or indentation after specified periods of time, or both.

Each of the above-identified standard test methods, namely ASTM D792-86, ASTM D 747-86, ASTM D 792-86, ASTM D 412-87, ASTM D 624-86 and ASTM D 2240-86, are incorporated herein by reference. Reference can be made directly to these standard test methods for the specific apparatus necessary, the specific procedures to be followed and the specific calculations to be made to obtain the values set forth above.

Disposed upon the mass-loaded vinyl sheet 13 is a second batt of thermal insulating material 14. Again, this second batt 14 of insulating material may be a ply of glass fiber or the like. Covering the outer exposed face of the second batt of insulating material 14 is a heat-reflective backing 15, such as aluminum foil. This backing is preferably moisture-resistant.

Forming a base for the wall panel 10 is a retainer 16, which is preferably wire mesh of a No. 16 gauge galvanized material. As shown in FIG. 2, the mass-loaded vinyl sheet 13 has its peripheral edges bent at right angles to form retaining flanges 17 which embrace the corresponding peripheral edges of the first fibrous insulating batt 12. When the panels are assembled into a complete unit, it is desirable to have these retaining flanges 17 mating with like flanges of adjacent panels to assure their functioning as an acoustical barrier.

As shown in FIG. 3, the corrugated facing 11 provides a free-standing end edge 18 that extends laterally from the panel 10. The opposite parallel end edge of the corrugated facing 11 provides an outwardly-extending shoulder 19 which is of a length less than the full depth of the corrugation. The shoulder 19 of one panel will embrace a portion of the corrugated wall 20 of the adjacent panel, while the free-standing end 18 will lie in facial abutment with a like disposed surface 21 of the first corrugation of the adjacent panel. These portions are then adapted to be fastened and connected together by a suitable sheet metal screw or the like. It may be desirable to provide oppositely-extending flanges 23 on the adjacent mass-loaded vinyl sheet 13 so that the flanges perform the additional function of retaining the fibrous insulated batt in its desired configuration.

The sectional view shown in FIG. 4 is comparable to that shown and described in FIGS. 2 and 3, with the addition thereto of a second mass-loaded vinyl sheet 24, which is disposed beneath the retaining mesh 16. The ends of the second mass-loaded vinyl sheet 24 are formed to provide peripheral flanges 25 that embrace the peripheral edges of the adjacent second mass-load vinyl sheet 24.

To assemble the panel as a prefabricated unit, the corrugated facing 11 is provided with a plurality of rearwardly-extending connector pins 26 which have their base portions, by means of welding or the like, fixedly connected to the inner crest of the corrugation, as shown. The components of the panel may be readily impinged upon the connector pins 26 into a unitary structure, as shown in FIGS. 5 and 7. It should also be noted that in the preferred embodiment, the connector pins 26 are welded to the corrugated facing 11.

As the free end of the connector pins 26 passes through the wire mesh 16, it is desirable to provide a fastener plate 27 over the exposed pin to aid in retaining the same in its relation to the components of the panel. This fastener plate 27 is generally of a substantially rectangular shape and is provided with a center aperture 28 through which the free end of the connector pin 26 is bent so as to not only connect the fastener plate 27 to the exterior of the panel 10, but also prevent the sharpened end 30 of the pin 26 from protruding from the face of the batt in an undesired condition.

In FIG. 6, there is shown a modified connector pin 31 which has its free penetrating end bifurcated so as to provide a pair of tabs 32. When the pin is journalled through the center aperture 33 of its associated fastener plate 27, the bifurcated tabs 32 may be bent in opposite directions into facial abutment with the fastener plate 27 to secure the same thereto.

FIG. 7 illustrates a modified sectional view of the invention in which the facing member 34 is formed with wave-like corrugations rather than with the rib formations, shown in FIGS. 1 through 4.

While a specific embodiment has been illustrated and described, it will be understood by those skilled in the art that various changes may be made and equivalents may be substituted for elements thereof without departing from the broader aspects of the invention.

I claim:

1. A thermal and acoustical insulation panel assembly having a plurality of superimposed members, the insulation panel assembly comprising:

a rigid facing;

a first thermally-insulating batt covering one side of said rigid facing;

an acoustically-insulating mass-loaded vinyl sheet having a thickness of about 0.03 inch, a base weight of about 1 lb./sq. ft. and an apparent bending modulus of about 25.2 mega pascals and covering said first batt;

a second thermally-insulating batt covering said mass-loaded vinyl sheet;

a thermally-reflective backing covering said second batt;

a retainer positioned upon said backing; and, means for securing the plurality of superimposed members together.

2. The insulation panel assembly of claim 1, wherein said mass-loaded vinyl sheet has a specific gravity of about 1.87 grams/cu.-centimeter.

3. The insulation panel assembly of claim 2, wherein said mass-loaded vinyl sheet has a tensile strength of about MD=415 psi and AMD=409 psi.

4. The insulation panel assembly of claim 3, wherein said mass-loaded vinyl sheet has a percent elongation of about MD=105% and AMD=128%.

5. The insulation panel assembly of claim 4, wherein said mass-loaded vinyl sheet has a tear of about MD=92 lbfs./in. and AMD=91 lbfs./in.

6. The insulation panel assembly of claim 5, wherein said mass-loaded vinyl sheet has a hardness of about 84 Type A-2 Shore durometers.

7. The insulation panel assembly of claim 1, wherein said retainer is a wire mesh.

8. The insulation panel assembly of claim 1, wherein said backing is a moisture-resistant foil.

9. The insulation panel assembly of claim 1, wherein said rigid facing is both metallic and corrugated.

10. The insulation panel assembly of claim 1, wherein said first and second batts are equal in both size and substance.

11. The insulation panel assembly of claim 1, wherein said first batt has peripheral edges and said mass-loaded vinyl sheet has portions bent upon and covering said peripheral edges of said first fibrous batt.

12. The insulation panel assembly of claim 1, wherein said means for securing the plurality of superimposed members together is a plurality of connectors carried by said facing and extending through said first batt, said mass-loaded vinyl sheet, said second batt, said backing and said retainer, and attached to a fastener plate.

13. The insulation panel assembly of claim 1, wherein said facing is sized larger than said remaining superimposed members and has end edge portions adapted for superimposing upon juxtaposed panels to form a continuous self-supporting insulated wall.

14. The insulation panel assembly of claim 1, further including a plurality of sound absorbing mats disposed upon opposite surfaces of said insulating batts.

15. A thermal and acoustical insulation panel assembly having a plurality of superimposed members, the insulation panel comprising:

a. a corrugated metallic facing;

b. a first thermally-insulating fibrous batt covering one side of said corrugated metallic facing, said first fibrous batt having peripheral edges;

c. an acoustically-insulating mass-loaded vinyl sheet covering said first fibrous batt and have portions bent upon and covering said peripheral edges of said first fibrous batt, said mass-loaded vinyl sheet having a thickness of about 0.03 inches, a base weight of about 15.7 ounces/sq.-ft., an apparent bending modulus of about 25.2 mega pascals, a specific gravity of about 1.87 grams/cu.-centimeter, a tensile strength of about MD=415 psi and AMD=409 psi, a percent elongation of about MD=105% and AMD=128%, a tear of about MD=92 lbfs./in. and AMD=91 lbfs./in., and a hardness of about 84 Type A-2 Shore durometers;

d. a second thermally-insulating fibrous batt covering said mass-loaded vinyl sheet, said first and second fibrous batts being equal in size;

e. a moisture-resistant thermally-reflective foil backing covering said second fibrous batt;

f. a wire mesh retainer positioned upon said backing; and, g. a plurality of connectors securing the superimposed members together, said connectors being carried by said facing and extending through said first fibrous batt, said mass-loaded vinyl sheet said second fibrous batt, said foil backing and said wire mesh retainer, and attached to a fastener plate.

16. The insulation panel of claim 15, wherein said facing is sized larger than said first and second fibrous batts, said mass-loaded vinyl sheet, said foil backing and said wire mesh retainer and provided with end edge portions adapted for superimposing upon juxtaposed panels to form a continuous self-supporting insulated wall.

17. The insulation panel of claim 15, further including a plurality of sound absorbing mats disposed upon opposite surfaces of said insulating batts.

* * * * *